US006577827B2

(12) United States Patent
Matsuura et al.

(10) Patent No.: US 6,577,827 B2
(45) Date of Patent: Jun. 10, 2003

(54) IMAGE FORMING APPARATUS AND METHOD THEREOF

(75) Inventors: Masahiko Matsuura, Suita (JP); Hiroshi Mizuno, Ikoma (JP); Takaji Kurita, Osakasayama (JP); Masashi Yamamoto, Settsu (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/988,487

(22) Filed: Nov. 20, 2001

(65) Prior Publication Data

US 2002/0061197 A1 May 23, 2002

(30) Foreign Application Priority Data

Nov. 22, 2000 (JP) ..... 2000-355964

(51) Int. Cl.[7] ..... G03G 15/00; G03G 21/00

(52) U.S. Cl. ..... 399/45; 345/107; 399/1; 399/82; 399/389; 399/390

(58) Field of Search ..... 399/45, 82, 85, 399/23, 389, 390, 1; 271/145, 152; 345/107

(56) References Cited

U.S. PATENT DOCUMENTS 5,053,814 A * 10/1991 Takano et al. ..... 271/145
5,781,822 A 7/1998 Nishiyama et al. ..... 399/1
5,866,284 A * 2/1999 Vincent ..... 345/107
6,386,676 B1 * 5/2002 Yang et al. ..... 399/389 X
6,397,020 B1 * 5/2002 Kim ..... 399/45 X
2002/0071687 A1 * 6/2002 Matsuura et al. ..... 399/45

FOREIGN PATENT DOCUMENTS

| | | | |
|---|---|---|---|
| JP | 06-043682 A | | 2/1994 |
| JP | 06-075508 A | | 3/1994 |
| JP | 08-248709 | * | 9/1996 |
| JP | 2000-250249 A | | 9/2000 |
| JP | 2000-352908 A | | 12/2000 |
| JP | 2001-109183 A | | 4/2001 |

* cited by examiner

*Primary Examiner*—Sophia S. Chen
(74) *Attorney, Agent, or Firm*—Sidley Austin Brown & Wood LLP

(57) ABSTRACT

An image forming apparatus is provided which forms images on both a concavo-convex sheet having a concavo-convex surface on which is formed many concavities capable of receiving toner and from which toner can be removed, and a general-purpose sheet which is not specially processed. The image forming apparatus has a first mode for forming an image on a general-purpose sheet, and a second mode for forming an image on a concavo-convex sheet. In the first mode, a general-purpose sheet receives a transferred toner image in the image forming region, and thereafter is guided to a fixing unit, where the toner is fixed on the sheet. In the second mode, a concavo-convex sheet receives a transferred toner image in the image forming region, and thereafter does not pass through the fixing unit but is guided to a convexity cleaning unit, where toner adhered to the convexities of the concavo-convex sheet during transfer is removed.

37 Claims, 9 Drawing Sheets

FIG. 11a
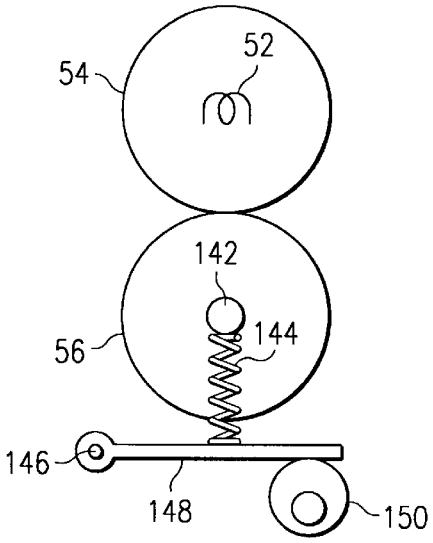
FIG. 11b
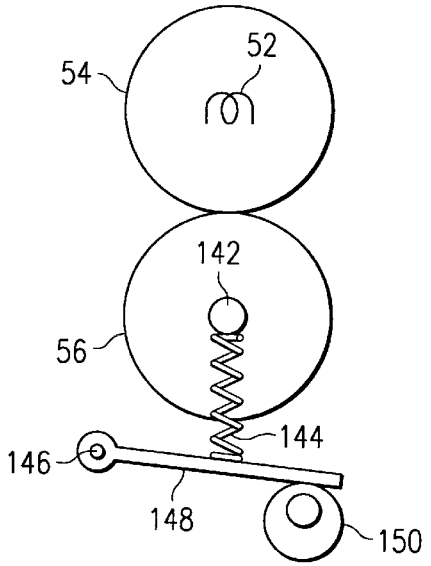
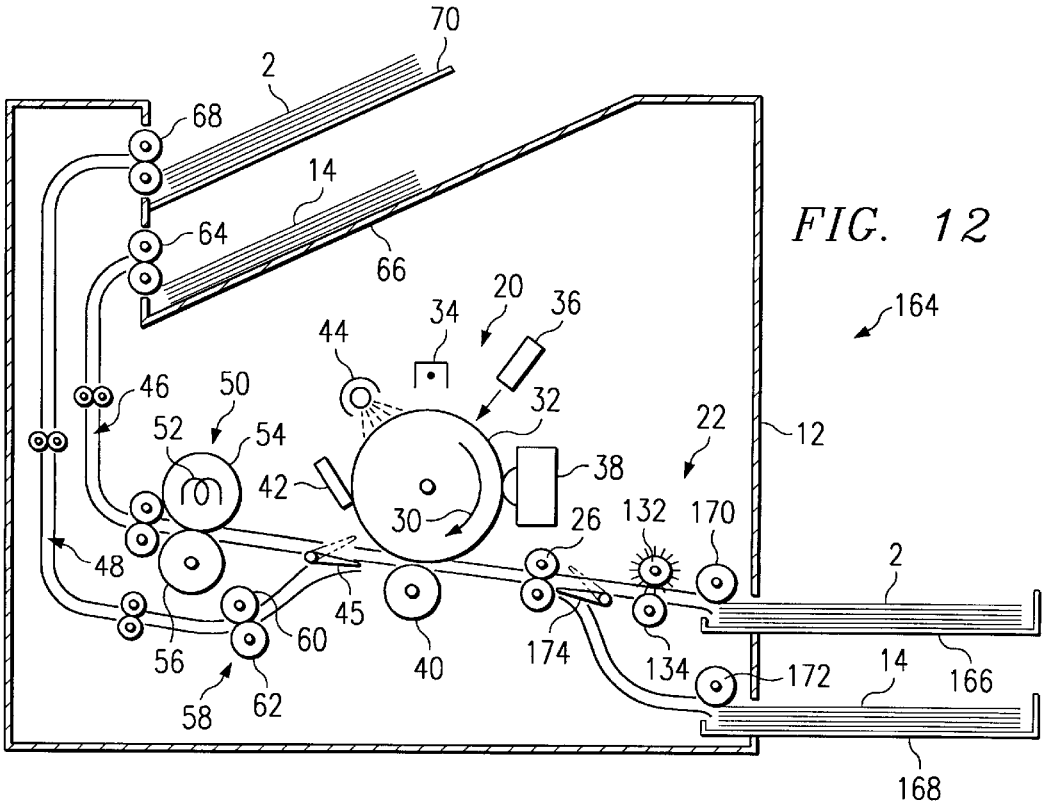
FIG. 12

IMAGE FORMING APPARATUS AND METHOD THEREOF

This application is based on Patent Application No. JP2000-355964 filed in Japan, the contents of which are hereby incorporated by reference.

BACKGROUND OF THE INVENTION

1. Field of the Invention

The present invention relates to an improved image forming apparatus and image forming method. More specifically, the present invention relates to an improved image forming apparatus and method for outputting a general-purpose sheet such as plain paper, overhead projector transparency and the like, as well as a concavo-convex sheet having a concavo-convex surface on which is formed many concavities capable of receiving toner and from which toner is removable.

2. Description of the Related Art

Currently, recording sheets such as copier paper, printer paper, OBH transparencies and the like are used in large volume for forming images (e.g., text and graphics) in copiers, printers and the like. Most of these recording sheets are disposed of after use, and present both an environmental problem and a resource problem. Accordingly, it is desirable to use a recording sheet from which an image formed on the recording sheet can be removed repeatedly in order to solve this problem.

In practice, the toner adhered to a recording sheet used in copiers, printers and the like is insoluble in water and is not easily removed. Furthermore, although removing toner by the use of organic solvents has been considered, there is concern of adverse effects on humans and the environment.

To resolve these problems, a concavo-convex sheet having a concavo-convex surface on which is formed many concavities capable of receiving toner and from which toner is removable (hereinafter referred to as "concavo-convex sheet"), and an image forming apparatus using this sheet has been proposed, for example by the present applicant in Japanese Patent Filing No. H11-281812. This image forming apparatus uses the electrophotographic method, and develops an electrostatic latent image formed on an image carrier (photosensitive drum) with toner, and thereafter electrically transfers the toner to the concavo-convex sheet. At this time most of the toner adheres to the concavities of the concavo-convex sheet, but since part of the toner adheres to the convexities, and electrostatic force is applied to the toner on the convexities so as to remove the toner. Since the toner within the concavities forming the image on the concavo-convex sheet is protected from external action (e.g., rubbing by fingers and the like) by the convexities there is no need to provide a fixing device for adhering the toner to the sheet in the image forming apparatus. However, since toner within a concavity is held within the concavity only by the electrostatic force from the electrical load of the sheet in the transfer process, the toner within the concavity can be removed by the action of an electrostatic force.

The present inventors believe the consumption of recording papers can be effectively reduced by using a general-purpose sheet such as widely used plain paper and OHP transparency for long-term storage and presentations, while using a concavo-convex sheet, which can be used for repeated image formation and image removal, for temporary recording and reading.

OBJECTS AND SUMMARY

In view of the previously described conditions, an object of the present invention is to provide an improved image forming apparatus and image forming method More specifically, an object of the present invention is to provide an improved image forming apparatus and image forming method for forming images on both a concavo-convex sheet and a general-purpose sheet which does not require special processing.

In order to attain these and other objects, an image forming apparatus according to an embodiment of the present invention comprises a first mode for forming an image by applying toner to a general-purpose sheet, a second mode for forming an image by applying toner to a concavo-convex sheet having a concavo-convex surface, on which is formed many concavities capable of receiving toner, and a mode-switching unit for switching between a plurality of modes, wherein the plurality of modes includes the first mode and the second mode.

An image forming apparatus according to the present invention may be provided with a sheet-type detector for detecting whether a sheet is a general-purpose sheet or a concavo-convex sheet, wherein the mode-switching unit switches the image forming apparatus to the first mode when the sheet-type detector detects that the sheet is a general-purpose sheet, and wherein the mode-switching unit switches the image forming apparatus to the second mode when the sheet-type detector detects that the sheet is a concavo-convex sheet.

An image forming apparatus according to the present invention may also be provided with a sheet supply unit for receiving sheets from a removable source of sheets, and a source-type detector for detecting whether a removable source of sheets is a source of general-purpose sheets or a source of concavo-convex sheets when the removable source is in a specific location, wherein the mode-switching unit switches the image forming apparatus to the first mode when the source-type detector detects that the removable source is a source of general-purpose sheets, and wherein the mode-switching unit switches the image forming apparatus to the second mode when the source-type detector detects that the removable source is a source of concavo-convex sheets In an image forming apparatus in accordance with the present invention, the mode-switching unit may switch to one of the plurality of modes based on the type of application outputting data to the image forming apparatus. Alternately, the mode-switching unit may switch to one of the plurality of modes based on instruction received from an application outputting data to the image forming apparatus.

In an image forming apparatus in accordance with the present invention, the mode-switching unit may switch to one of the plurality of modes based on user input.

An image forming apparatus according to the present invention may be provided with a user input device for allowing a user to select one of the plurality of modes.

An image forming apparatus according to the present invention may be provided with an electrostatic latent image carrier, a device for forming electrostatic latent image on the electrostatic latent image carrier, a developing device for developing an electrostatic latent image with toner as a toner image, a transfer device for electrostatically transferring the toner of a toner image onto a general-purpose sheet or concavo-convex sheet, and a fixing device for fixing the thus transferred toner on a general-purpose sheet in the first mode, wherein the fixing device is substantially inactive for fixing toner in the second mode.

An image forming apparatus according to the present invention may be provided with a convexity cleaner, disposed on the downstream side of the transfer device relative to the transport direction of a concavo-convex sheet, for removing toner adhered to the convexities of a concavo-convex sheet in the second mode.

An image forming apparatus according to the present invention may be provided with a mismatch indicator for providing an indication to a user when a type of sheets available to the image forming apparatus is incompatible with a mode that has been selected. The mismatch indicator may be any type of indicator, including visual and/or audible types of indicators, such as text on a display device, a lamp, an LED, a buzzer and/or an alarm of some sort.

An image forming method in accordance with the present invention comprises the steps of forming an image by applying toner onto a general-purpose sheet in a first mode, forming an image by applying toner onto a concavo-convex sheet having a concavo-convex surface on which is formed many concavities capable of receiving toner in a second mode, and switching between a plurality of modes, wherein the plurality of modes includes the first mode and the second mode.

An image forming method according to the present invention may also include the step of detecting whether a sheet is a general-purpose sheet or a concavo-convex sheet, wherein the first mode is switched to when a sheet is detected to be a general-purpose sheet, and wherein the second mode is switched to when a sheet is detected to be a concavo-convex sheet.

An image forming method according to the present invention may further include the steps of receiving sheets from a removable source of sheets and detecting whether the removable source of sheets is a source of general-purpose sheets or a source of concavo-convex sheets, wherein the first mode is switched to when the source of sheets is detected to be a source of general-purpose sheets, and wherein the second mode is switched to when the source of sheets is detected to be a source of concavo-convex sheets.

In an image forming method of the present invention, one of the plurality of modes may be switched to based on the type of application outputting data for image formation. Alternately, one of the plurality of modes may be switched to based on instruction received from an application outputting data for image formation.

In an image forming method of the present invention, one of the plurality of modes may be switched to based on user input.

An image forming method in accordance with the present invention may include the steps of activating a fixing device for fixing toner on a general-purpose sheet in the first mode and deactivating the fixing device in the second mode.

Finally, an image forming method in accordance with the present invention may include the step of removing toner from convexities on a concavo-convex sheet after image formation in the second mode.

BRIEF DESCRIPTION OF THE DRAWINGS

These and other objects and features of the present invention will become apparent from the following description of the preferred embodiments thereof taken in conjunction with the accompanying drawings, in which:

FIG. 11 is a side view of an example of a mechanism for adjusting the contact force between a pressure roller and heating roller of a fixing device, part (a) shows the state in the operation mode using a general-purpose sheet, and part (b) shows the state in the operation mode using a concavo-convex sheet;

FIG. 12 is a cross-sectional view showing a third embodiment of the image forming apparatus of the present invention;

In the following description, like parts are designated by like reference numbers throughout the several drawings.

DETAILED DESCRIPTION OF THE PREFERRED EMBODIMENTS

The embodiments of the present invention are described hereinafter with reference to the accompanying drawings. In the following description, "downstream side relative to the sheet transport direction" and "upstream side relative to the sheet transport direction" are respectively referred to simply as "downstream side" and "upstream side."

First Embodiment

Figure 1:
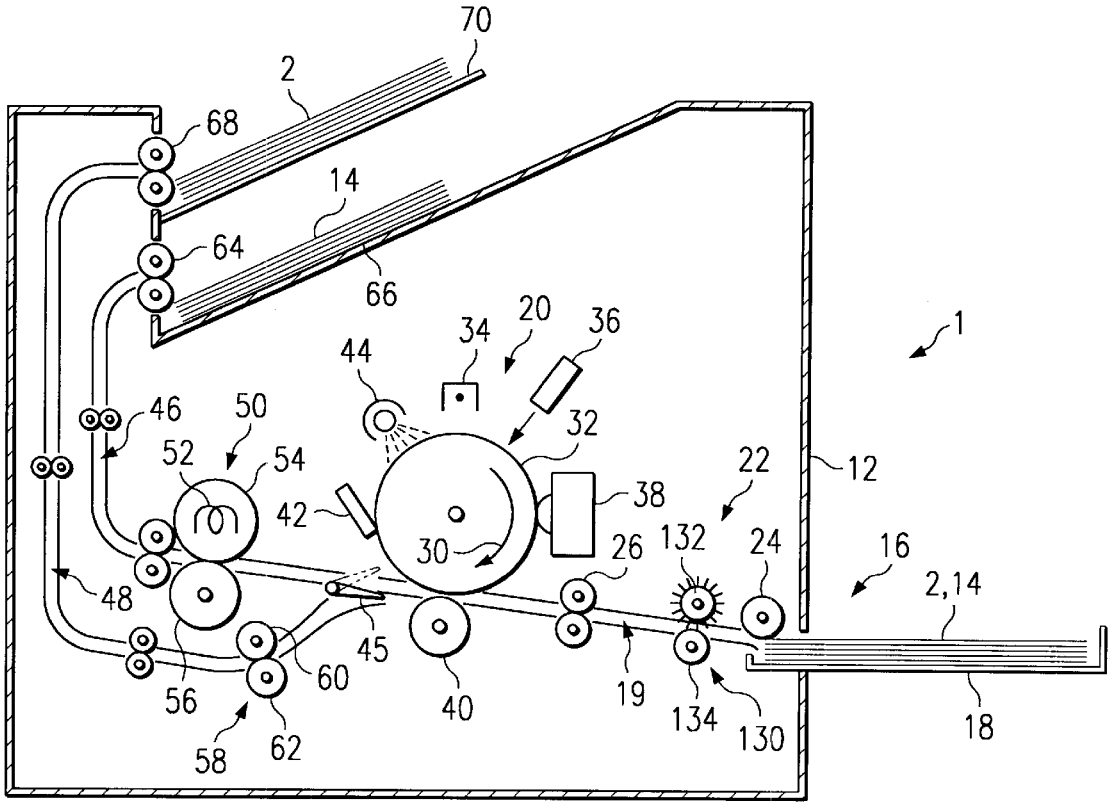
FIG. 1 is a cross-sectional view showing a first embodiment of the image forming apparatus of the present invention.

FIG. 1 is a view of a first embodiment of an image forming apparatus of the present invention. An image forming apparatus 1 is provided with a general-purpose sheet operation mode for printing on a sheet such as copier paper, printer paper, OHP transparency and the like (hereinafter referred to as "general-purpose sheet"), and a concavo-convex sheet operation mode for printing on a concavo-convex sheet having a concavo-convex surface on which is formed many concavities capable of receiving toner and from which toner is removable, as described below.

Figure 2A:
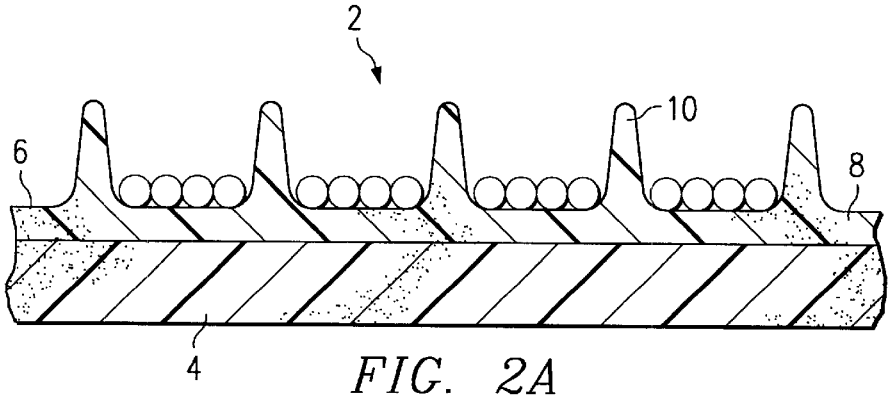
FIG. 2(*a*) is an enlarged cross-sectional view of a part of a concavo-convex sheet, and FIG. 2(*b*) is an enlarged perspective view of an example of a portion of a concavo-convex sheet having continuous channel-like concavities.
Figure 2B:
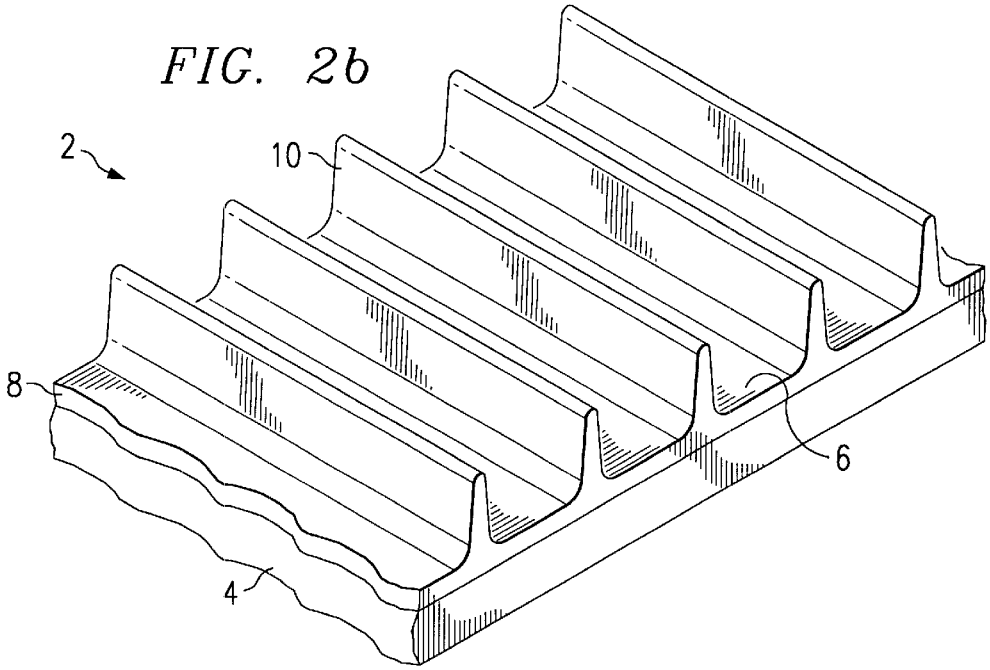

A concavo-convex sheet 2 includes a surface layer 8 having a plurality of concavities 6 capable of receiving toner formed on one surface of a base layer 4, as shown in FIG. 2(*a*), although the concavo-convex sheet 2 is not limited to this structure. Toner is exaggerated in the drawing. Various types of materials may be used as the base layer 4, including combinations of paper, synthetic resin (e.g., polyester, polyethylene terephthalate, polyolefin (e.g., polypropylene, polyethylene and the like), polyimide, polyamide and the like). The surface layer 8 having a concavo-convex surface characterized by a plurality of concavities 6 and convexities 10 may be formed, for example, by applying on the base layer 4 a material such as synthetic resin (e.g., thermosetting resins such as polyethylene, acrylic, polyester and the like), or extender pigments, and white pigments such as titanium oxide, zinc oxide silica, alumina, clay, talc kneaded with the aforesaid resins, and forming specific concavities 6 by superimposing a mold (e.g., master roller) thereon and applying a heat press. The concavities 6 also may be formed by pouring the resin into a suitable mold. The concavities 6 which are formed in continuous channels, for example, as shown in FIG. 2(*b*), are suitable. However, a flat area on the surface layer 8 on which are formed dot-like convexities 10 may also be used. When the concavities 6 are formed as continuous channels, it is desirable that the concavities 6 are systematic, and have a width double or greater than an average particle size of the toner, and it is further desirable that the width is 20~500 $\mu$m, and the depth is 20~100 $\mu$m. It is desirable that each convexity 10 has a width which is 1/50 to ½ the width of each concavity 6. Sheets usable as a concavo-convex sheet are described in detail in Japanese Patent Filing No. H11-281812 by the present applicant.

The application of resin may be replaced by overlaying a resin film on the substrate layer, superimposing a mold thereon, and applying heat and pressure. An alternative example is a method which forms a polymer film on a substrate layer as a resist, and removes the parts equivalent to concavities by and optical exposure process through a mask.

Returning to FIG. 1, each structural part of the apparatus 1 will now be described. A sheet supply unit 16 for feeding general-purpose sheets 14 and concavo-convex sheets 2 is provided near the wall of housing 12 on an exterior side of the apparatus 1. The sheet supply unit 16 has a cassette 18 or tray supporting stacked sheets 2 and 14, and a feed mechanism 22 for acquiring the sheets 2 and 14 one sheet at a time, and transporting the acquired sheets 2 and 14 through the interior of a first path 19 to an image forming unit 20. In the case of a concavo-convex sheet 2 in the mode shown in the drawing, the concavo-convex sheets 2 are stacked in the cassette 18 with the concavo-convex surface facing upward. The feed mechanism 22 is provided with a take-up roller 24 for separating a top sheet 2 or 14 from the cassette 18 and feeding the sheet 2 or 14 to the interior of the housing 12. A pair of timing rollers 26 are disposed near the image forming unit 20 and rotate when an image signal is received so as to feed the sheet 2 or 14 to the image forming unit 20.

The image forming unit 20 has a photosensitive drum (image carrier) 32 which is rotatable in the arrow 30 direction. Arranged sequentially around the circumference of the image carrier 32 along the direction of rotation of the image carrier 32 is a corona charger 34 for uniformly charging the surface of the image carrier 32, an exposure device 36 for selectively irradiating light onto the image carrier 32 in accordance with image information so as to form a latent image on the image carrier 32, a developing device 38 for supplying charged toner to the image carrier 32 to develop the latent image into a visible image, a transfer roller 40 for electrostatically transferring the toner supplied to the image carrier 32 by the developing device 38 to a sheet 2 or 14 transported along the first path 19, a cleaning device (e.g., cleaning blade) 42 for removing residual toner from the image carrier 32 after transfer, and a latent image erasing device (e.g., eraser lamp) 44 for eliminating the latent image on the image carrier 32 via irradiation with erasure light after transfer.

A switch 45 is provided on the downstream side of the image forming unit 20, which can move between the solid line position and the dotted line position. When the switch 45 is set at the solid line position, a general-purpose sheet 14 fed from the image forming unit 20 is guided to a second path 46 used for the general-purpose sheets 14; and when the switch 45 is set at the dotted line position, a concavo-convex sheet 2 is guided to a third path 48 for concavo-convex sheets 2. The switch 45 is moved to the solid line position when a detector, described later, detects that a sheet 2 or 14 on the cassette 18 is a general-purpose sheet 14, and the switch 45 is moved to the dotted line position when a sheet 2 or 14 on the cassette 18 is detected to be a concavo-convex sheet 2. Alternatively, a user may specify one of a general-purpose sheet operating mode and a concavo-convex sheet operating mode, and the position of the switch 45 may be changed in accordance with this user specification.

A fixing device 50 is provided along the second path 46 so as to melt the toner adhered to a general-purpose sheet 14 and fix the toner thereto. The fixing device 50 has a heating roller 54 provided with an internal heater 52 and pressure roller 56 abutting the heating roller 54 The rollers 54 and 56 are arranged vertically so as to form a transport path therebetween for the general-purpose sheet 14 along the second path 46. Either one of the rollers 54 and 56 may be driven by a motor (not shown).

A convexity cleaning unit 58 is provided along the third path 48 to electrically remove toner adhered to each convexity 10 (refer to FIG. 2) of a concavo-convex sheet 2. The convexity cleaning unit 58 shown in the drawing has a collector roller 60 and an opposing roller 62 opposite each other and arranged vertically so as to form a sheet transport path therebetween. A blade (not shown) is provided in contact with the surface of the collector roller 60 to sweep toner on the collector roller 60. Either one of the rollers 60 and 62 may be driven by a motor (not shown) Specific bias voltages are applied to the collector roller 60 and opposed roller 62, each of which are conductive (e.g., when the toner is negatively charged, a bias voltage of +300 V is applied to the collector roller 60 while the opposing roller 62 is grounded), and in this way charged toner is electrically attracted from the opposing roller 62 to the collector roller 60, and only the toner on the convexities 10 of the concavo-convex sheet 2 is adhered to the surface of the collector roller 60. In the case of magnetic toner, a magnetic force may be used to effectively remove the toner from the convexities 10. Furthermore, the collector roller 60 used to adhere toner may be replaced by a roller with projections, a rotating belt, a rotating belt with projections, or the like.

A general-purpose sheet 14 passing through the second path 46 is ejected via a pair of discharge rollers 64 to a discharge unit 66 formed by part of the exterior wall of the housing 12. Similarly, a concavo-convex sheet 2 passing through the third path 48 is ejected via a pair of discharge rollers 68 to a tray 70.

According to this structure, in the general-purpose sheet operating mode, the corona charger 34 discharges at the image carrier (photosensitive drum) 32 which is rotated in the arrow 30 direction so as to charge the surface of the image carrier 32. Then, the image carrier 32 is selectively irradiated by light from the exposure device 36 based on image information. As a result, an electrostatic latent image is formed on the surface of the image carrier 32. This electrostatic latent image is developed by the developing device 38 as a visible toner image. This toner image is moved opposite the transfer roller 40 in conjunction with the rotation of the image carrier 32, and is transferred onto a general-purpose sheet 14 guided from the cassette 18 to the image forming unit 20 via the first path 19. Thereafter, the general-purpose sheet 14 is guided to the second path 46 via the switch 45 set at the solid line position, and the toner is melted and fixed to the general-purpose sheet 14 in the fixing device 50. Finally, the general-purpose sheet 14 is ejected to the discharge unit 66 via the nip of the pair of discharge rollers 64.

Residual toner which was not transferred to the general-purpose sheet 14 at the area opposite the transfer roller 40 is removed by the cleaning device 42. The latent image on the image carrier 32 is erased by erasure light emitted from the latent image erasing device 44.

In the concavo-convex sheet operating mode, toner image on the image carrier 32 is transferred to a concavo-convex sheet 2 guided from the cassette 18 through the first path 19 to the image forming unit 20 in the same manner as in the general-purpose sheet operating mode. Thereafter, the concavo-convex sheet 2 is guided to the third path 48 via the switch 45 set at the dotted line position, and toner adhered to the convexities 10 is removed by the convexity cleaning unit 58. Finally, the concavo-convex sheet 2 is discharged onto the tray 70 via the nip of the pair of discharge rollers 68.

In the concavo-convex sheet operating mode and the general-purpose sheet operating mode, the settings of each device used for developing, charging, exposure, and transfer in the image forming unit 20 may be modified (e.g., values may be changed for the developing bias voltage applied to the developing roller of the developing device 38, the surface potential of the photosensitive member charged by the corona charger 34, the intensity of the light emitted by the exposure device 36, bias voltage applied to the transfer roller 40 and the like).

Operating Mode Selection Method

The selection of either the general-purpose sheet operating mode or the concavo-convex sheet operating mode may be accomplished automatically, or by user specification. Each case of mode selection is described below.

(1) selecting operating mode automatically based on the detection of the type of sheet in the cassette

EXAMPLE 1

Figure 3:
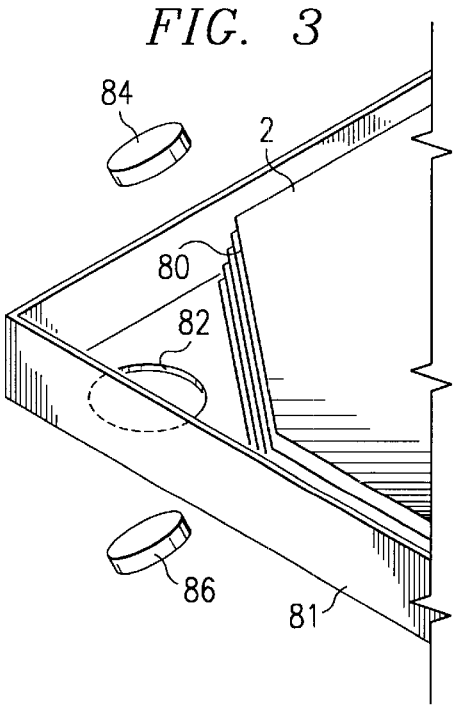
FIG. 3 is a perspective view of a detection mechanism for detecting sheet type.
Figure 4:
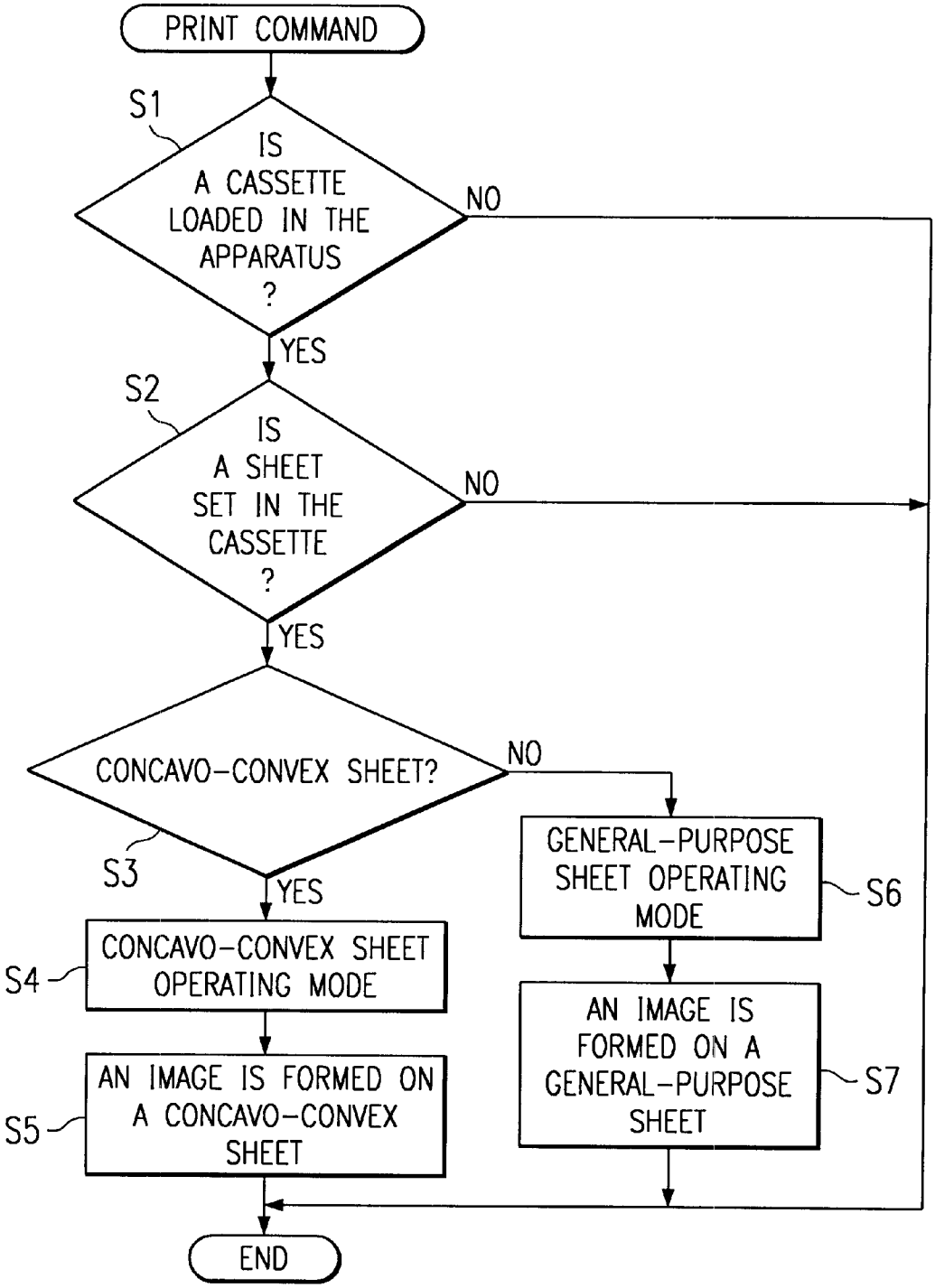
FIG. 4 is a flow chart of the printing operation using the detection mechanism of FIG. 3.
Figure 6A:
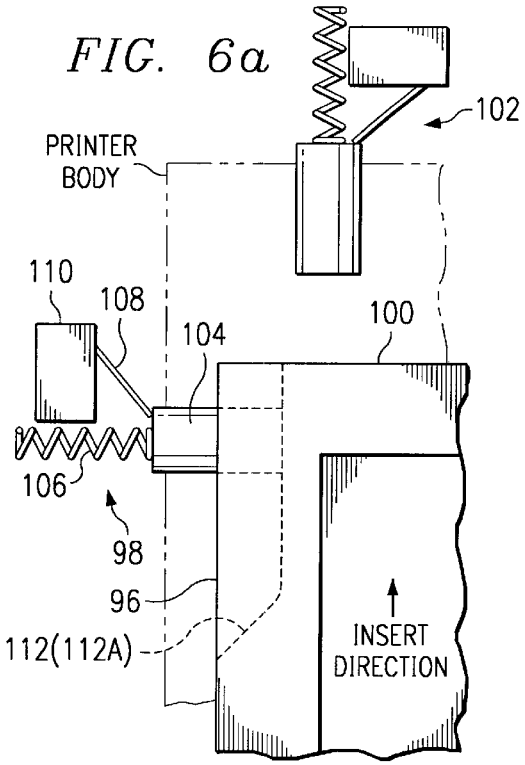
FIGS. 6(*a*)–6(*d*) are each a top view of a detection mechanism for detection of the type of sheet accommodating cassette.
Figure 6B:
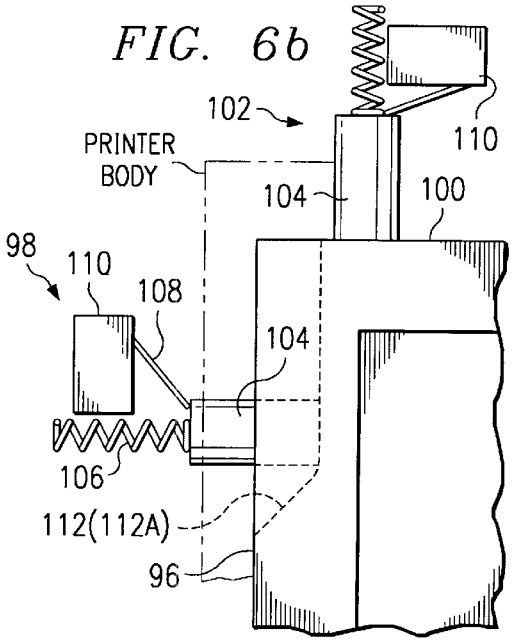
Figure 6C:
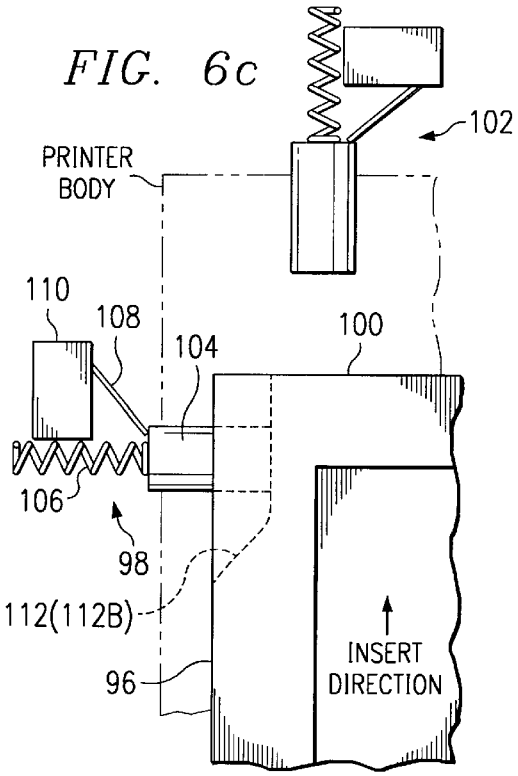
Figure 6D:
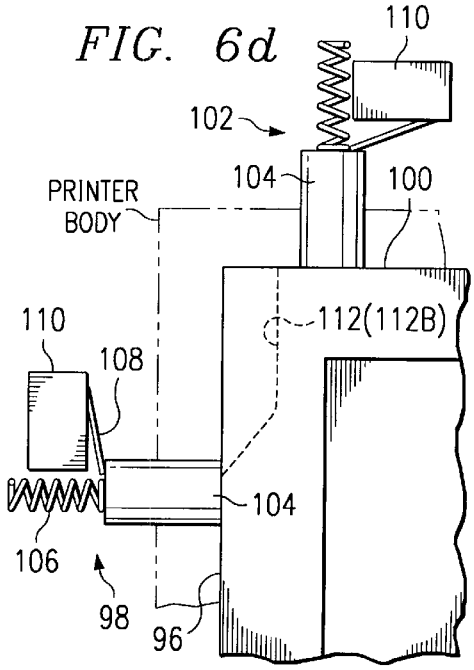

The external form of the concavo-convex sheet and general-purpose sheet are made different beforehand, and these shapes are detected optically. For example, as shown in FIG. 3, a concavo-convex sheet 2 provided with at least a notch 80 in one corner is used, and a hole 82 is provided in part of a cassette 81 corresponding to the notch 80. A light-emitting element 84 and light-receiving element 86 are arranged with the hole 82 interposed therebetween. According to this structure, a sheet in the cassette 81 can be detected as a concavo-convex sheet 2 or a general-purpose sheet 14. Referring to FIG. 1 and the flow chart of the print operation in FIG. 4, when a general-purpose sheet 14 is detected (step S3), the general-purpose sheet operating mode is selected (step S6), and a general-purpose sheet 14 is delivered to the fixing unit 50 after the toner has been transferred in the image forming unit 20 (step S7). When a concavo-convex sheet 2 is detected (step S3), the concavo-convex sheet operating mode is selected (step S4), and the concavo-convex sheet 2 is delivered to the convexity cleaning unit 58 after the toner has been transferred in the image forming unit 20 (step S5). Although shown in the flow chart, it goes without saying that printing is not performed when the cassette is not loaded in the apparatus (step S1), or when a sheet 2 or 14 is not set in the cassette (step S2).

EXAMPLE 2

Figure 5:
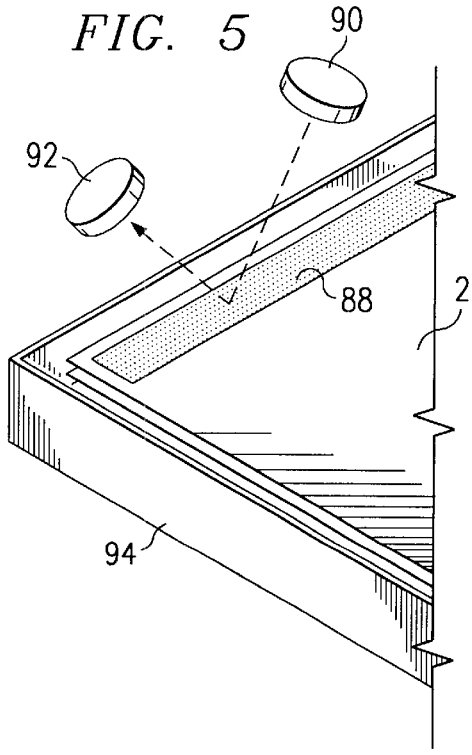
FIG. 5 is a perspective view of another detection mechanism for detecting sheet type.

As shown in FIG. 5, a marking 88 having different reflectivity than a general-purpose sheet 14 is provided on part of the surface of the concavo-convex sheet 2, such that light emitted from a light-emitting element 90 provided at a specific position is reflected by the marking and received by a light-receiving element 92. According to this structure, whether a sheet set in a cassette 94 is a concavo-convex sheet 2 or a general-purpose sheet 14 can be detected from the intensity of the light received by the light-receiving element 92.

Example 1 is effective when only concavo-convex sheets 2 are set in the same cassette. Conversely, example 2 is capable of identifying sheets even when the concavo-convex sheets 2 and the general-purpose sheets 14 are mixed in the same cassette.

Other Examples

The type of sheet may also be detected by detecting physical values such as the static capacity, surface resistance value, magnetic quantity and the like of the sheet.

(2) Selecting mode automatically based on the detection of the type of cassette when a specific cassette among a concavo-convex sheet cassette and general-purpose sheet cassette is optionally loaded in the Printer

EXAMPLE 3

The entirety of FIG. 6 shows a detection mechanism for detecting the type of cassette. FIGS. 6(*a*) and 6(*b*) illustrate when a general-purpose sheet cassette is installed, and FIGS. 6(*c*) and 6(*d*) illustrate when a concavo-convex sheet cassette is installed. The detection mechanism has a first sensor 98 disposed opposite a first cassette exterior surface 96 extending in a direction parallel to the cassette insertion direction (vertical direction in the drawing), and a second sensor 102 disposed opposite a second cassette external surface 100 extending in a direction perpendicular to the external surface 96 (lateral direction in the drawing), in the installation path in the printer [FIG. 6(*a*), 6(*c*)] or [FIG. 6(*b*), 6(*d*)]. The first sensor 98 has a pin 104. The tip of the pin 104 contacts the first cassette exterior surface 96, and the base end of the pin 104 is connected to a spring 106, which extends in a lateral direction in the drawing, and is attached to one end of a metal flange. 108 The other end of the metal flange 108 makes contact with an electrical contact of a switch 110 when the pin 104 is pressed to the left side in the drawing by the first cassette exterior surface 96 as described later.

The first exterior surface 96 of the cassette is provided with a channel 112 for guiding the pin 104 of the first sensor 98 when the cassette is installed in the printer. One end of the channel 112 (top end in the drawing) is open, and the other end of the channel 112 (bottom end in the drawing) is formed with an inclined surface from the bottom of the channel 112 toward the flat part of the first exterior surface 96. The depth of the channel 112 (length in the lateral direction in the drawing) is set, for example, to the natural length of the spring 106 in a state wherein the pin 104 contacts the bottom of the channel 112. The channel 112 has different lengths in the insertion direction for the concavo-convex sheet cassette and the general-purpose cassette. That is, the length of channel 112B of the concavo-convex sheet cassette is set such that the pin 104 is pressed so as to abut the flat surface of the first exterior surface 96 at the left side in the drawing, as shown in FIG. 6(*d*), when the cassette is installed. On the other hand, the length of the channel 112A of the general-purpose sheet cassette is longer than the channel 112B of the concavo-convex sheet cassette, and is set such that the pin 104 contacts the bottom of the channel 112B as shown in FIG. 6(*b*) when the cassette is installed.

According to this structure, in the case of a concavo-convex sheet cassette, a switch 110 is turned ON when the cassette is installed, and, in the case of a general-purpose sheet cassette, the switch 110 remains OFF even when the cassette is installed. Accordingly, the first sensor 98 can detect the type of cassette.

On the other hand, the second sensor 102 has a structure identical to that of the first sensor 98, and detects a cassette installed in the printer regardless of the type of cassette. The second sensor 102 is disposed such that the pin 104 is pressed to the top side in the drawing by the second cassette exterior surface 100 and the switch 110 is turned ON when a cassette is installed.

According to these structures, the general-purpose sheet operating mode is selected when the installation of a general-purpose sheet cassette is detected by the first sensor 98 after the second sensor 102 detects the installation of a cassette in the printer. Furthermore, the concavo-convex sheet operating mode is selected when the installation of the concavo-convex sheet cassette is detected by the first sensor 98.

EXAMPLE 4

Figure 7:
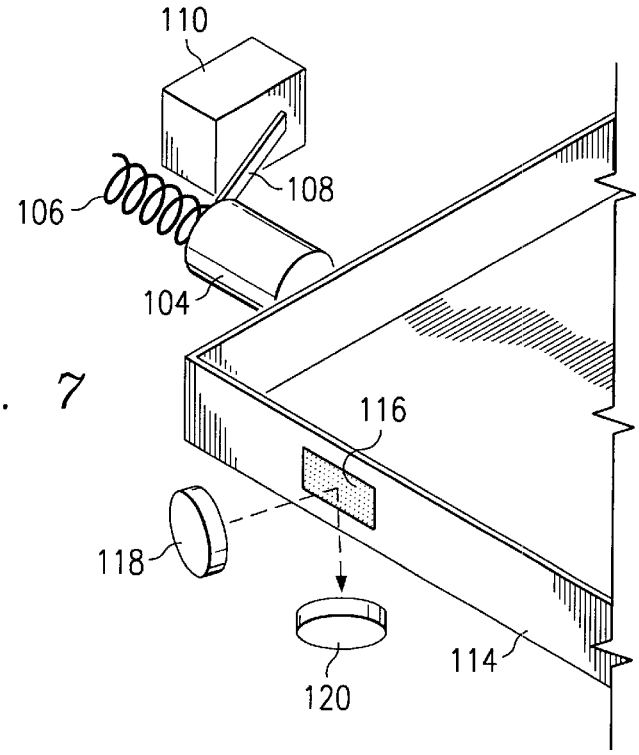
FIG. 7 is a top view of a another detection mechanism for detection of the type of sheet accommodating cassette.

The detection mechanism of FIG. 7 substitutes a sensor for optically detecting the type of cassette for the first sensor 98 for physically detecting the type of cassette in the detection mechanism of FIG. 6. Specifically, the concavo-convex sheet cassette and the general-purpose sheet cassette are provided with markings 116 having different reflectivities on the exterior surface (equivalent to the first exterior surface 96 of FIG. 6) of the cassette 114, such that light emitted from a light-emitting element 118 provided at a specific position is reflected by the marking and received by a light-receiving element 120. According to this structure, whether or not the installed cassette 114 is a concavo-convex sheet cassette or a general-purpose sheet cassette can be detected from the intensity of the light received by the light-receiving element 120.

(3) Selection of operating mode by user specification

EXAMPLE 5

Figure 8:
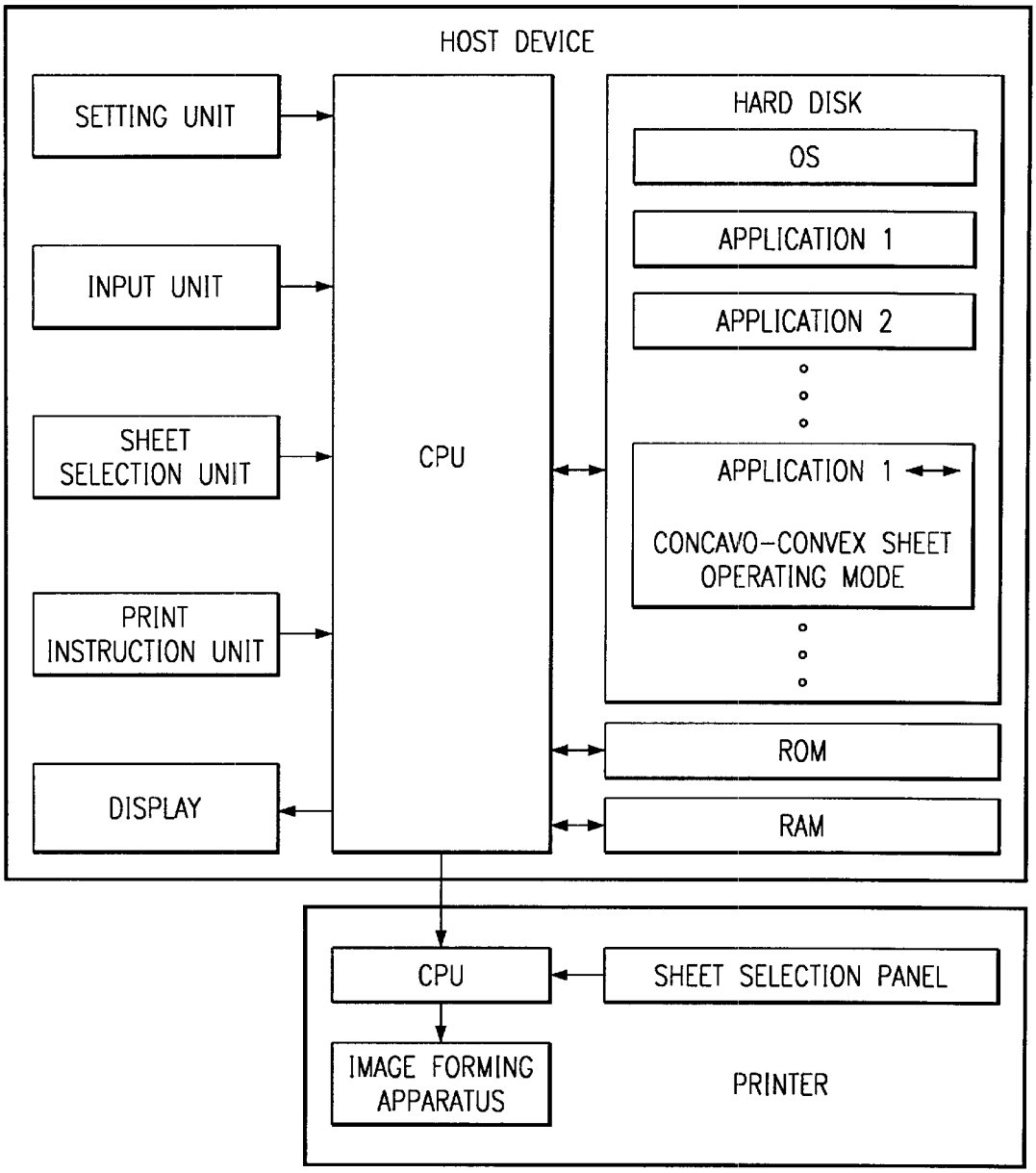
FIG. 8 is an example of a control circuit diagram for connecting a host device to the image forming apparatus of FIG. 1.

FIG. 8 shows an example of a control circuit of the image forming apparatus of the present invention suitable for a case where the operating mode is selected by user specification. The image forming apparatus is connected to a host device directly or indirectly via a network or the like. The CPU of the host device is connected to a selection unit for a user to select the type of sheet, input unit for normal operation, a print instruction unit for issuing print instructions to the image forming apparatus, RAM as a work area, ROM for storing programs executed by the CPU, and hard disk for storing various applications operating system and the like. A keyboard and mouse, for example, may be used as the selection unit, input unit, and print instruction unit. A display, connected to the CPU, displays output applications and the like called from RAM. The image forming apparatus is provided with a selection panel for a user to select a type of sheet, and this panel is connected to the CPU of the printer.

Figure 9:
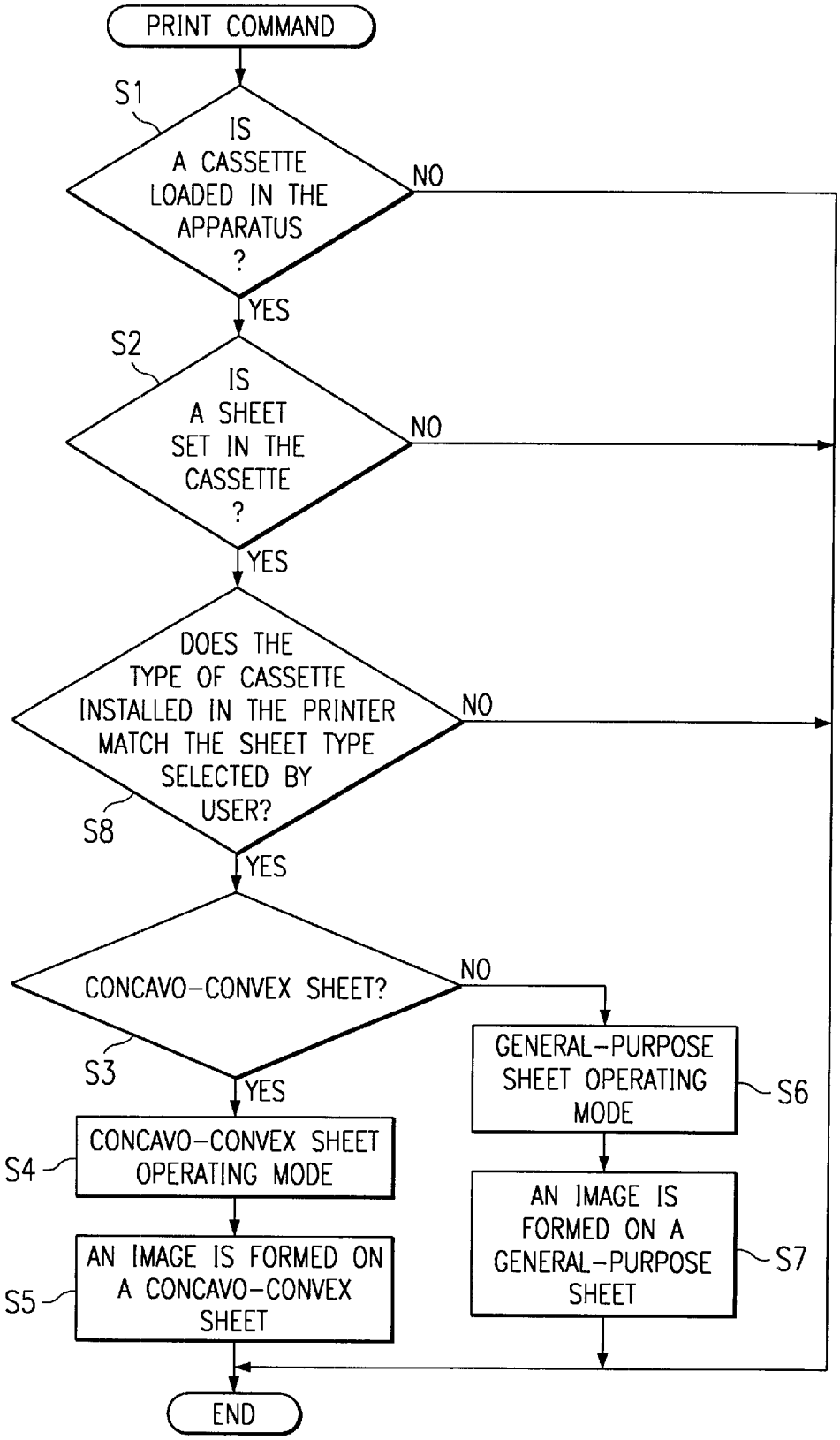
FIG. 9 is a flow chart of the printing operation in the example of FIG. 8.

According to this structure, a print instruction is issued for output of a desired application displayed on the display after a sheet type has been selected via the selection unit of the host device or the selection panel of the printer. As shown in the flow chart of this example in FIG. 9, printing is not executed when a user selects a sheet type and the selection does not match the type of cassette installed in the printer (step S8). In such a situation, a mismatch indication may be provided to the user via the display.

As previously described, using a concavo-convex sheet, which can be used for repeated image formation and image removal, for temporary recording and reading, and using a general-purpose sheet for long-term storage and presentations, is desirable to reduce the consumption of recording sheets by the printer. Accordingly, the concavo-convex sheet operating mode may be set by a user when printing the output of a specific application (application 1 in FIG. 8), e.g., a mailer or internet browser or the like, mainly for temporary recording and reading. However, when printing the output of other specific applications, the general-purpose sheet operating mode may be selected by a user (e.g., when the image forming apparatus has a facsimile function and prints output data from a facsimile). This setting is accomplished through a setting unit connected to the CPU.

As an alternative, an application may provide instruction for the selection of a print mode. For instance, an application may provide instruction for printing in the concavo-convex sheet operating mode since the type of data output for printing from the application is preferably only temporarily recorded in printed form. In such a case, each time the application sends data for printing, instruction is also provided so that the printing is carried out in the concavo-convex sheet operating mode. Similarly, an application may provide instruction for printing in the general-purpose sheet operating mode. An application may even provide instruction for printing a print job on a combination of concavo-convex sheets and general-purpose sheets. For example, it may be desirable for some pages of a document to be printed on concavo-convex sheets 2 and other pages of the same document to be printed on general-purpose sheets 14. Or, when printing multiple copies of a document, it may be desirable for some copies of the document to be printed on concavo-convex sheets 2 and for other copies of a document to be printed on general-purpose sheets 14. In these and other similar cases, instruction can be provided from an application rather than from a user to prevent a user from having to repeatedly provided a same mode selection. Finally, a user may also select a mode or combination thereof in an application, and the print mode of the image forming apparatus would be selected by instruction provided by the application in accordance with the selection made by the user.

Image Removal Unit

Returning to FIG. 1, an image removal unit 130 may be provided between the cassette 18 and the image forming unit 20. In this way, a printed concavo-convex sheet 2 is set in the cassette 18, then the image is removed by the image removal unit 130, and a different image can be formed thereon in the image forming unit 20. The image removal unit 130 shown in the drawing has a conductive brush roller 132 and an opposing roller 134 arranged vertically with the sheet transport path therebetween. A suitable means (e.g., device for electrically attracting the toner on the brush roller 132; not shown) for removing toner on the brush roller 132 is provided near the brush roller 132. One of the rollers 132 and 134 may be driven by a motor (not shown). The brush roller 132 has a many brushes flocked on the circumference of a core shaft, and these brushes contact the concavities 6 of a concavo-convex sheet 2 passing between the brush roller 132 and the opposed roller 134 so as to mechanically remove the toner within the concavities 6 by the brushes. Furthermore, toner also may be removed from the concavities 6 by being attracted to the brush and collected by applying a specific bias voltage to the brush roller 132 and opposing roller 134 (e.g., when the toner is negatively charged, a bias voltage of +1 kV is applied to the brush roller 132 while the opposing roller 134 is grounded). In the case of magnetic toner, a magnetic force may be used to reliably remove the toner.

Second Embodiment of Image Forming Apparatus

Figure 10:
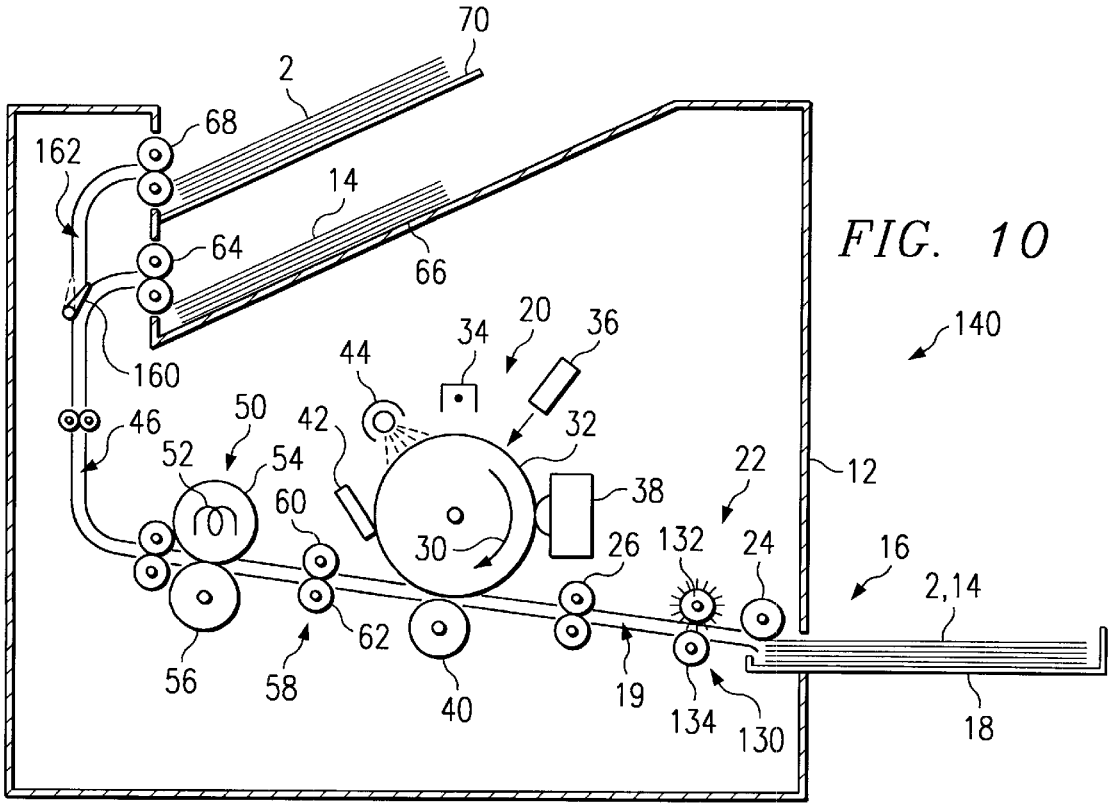
FIG. 10 is a cross-sectional view showing a second embodiment of the image forming apparatus of the present invention.

FIG. 10 shows a second embodiment of an image forming apparatus of the present invention. An image forming apparatus 140 passes all sheets 2 and 14 through the fixing device 50, however, in the concavo-convex sheet operating mode, the surface temperature of the heating roller 54 is reduced, and the contact force between the heating roller 54 and the pressure roller 56 is diminished such that the toner within the concavities 6 of a concavo-convex sheet 2 is not fixed. The power source to the internal heater 52 may be turned OFF to reduce the surface temperature of the heating roller 54.

An example of a mechanism for reducing the contact force between the heating roller 54 and the pressure roller 56 is shown in FIG. 11. One end of a spring 144 is connected to a core shaft 142 of the pressure roller 56. The other end of the spring 144 is connected to the near approximate center of a long thin arm 148 provided so as to be pivot about a shaft 146, and the spring 144 exerts a force on the pressure roller 56 toward the heating roller 54. The long thin arm 148 is supported by an eccentric roller 150 at the end on the opposite side from the shaft 146, such that the pressure force of the pressure roller 56 relative to the heating roller 54 can be adjusted by rotating the long thin arm 148 about the shaft 146 in accordance with the position of the eccentric roller 150. In the mode shown in FIG. 11, the contact force is set at maximum when printing on a general-purpose sheet 14 (minimum length of the spring 144) as shown in FIG. 11(*a*), and the contact force is set at minimum when printing on a concavo-convex sheet 2 (maximum length of the spring 144) as shown in FIG. 11(*b*). It is desirable, when a concavo-convex sheet 2 passes between the heating roller 54 and the pressure roller 56, that the contact force of the roller 54 and the roller 56 is approximately $1.5\times10^5$ Pa or less, and more desirably approximately $4.9\times10^4$~$9.8\times10^4$ Pa. In the concavo-convex sheet operating mode, the two rollers 54 and 56 may be completely separated. However, from the perspective of transportability, it is desirable for a sheet 14 to be transported through the nip in contact with the roller 54 and roller 56.

Returning to FIG. 10, it is desirable for the convexity cleaning unit 58 to be provided on the upstream side of the fixing device 50. The reason for the desirability of this placement is the possibility that the toner on the convexities 10 may flocculate due to the contact force of the heating roller 54 and pressure roller 56 and, as a result, the image may become difficult to remove.

A sheet 2 or 14 passing through the fixing device 50 is suitably discharged by the individual discharge unit 66 in accordance with the general-purpose sheet operating mode and concavo-convex sheet operating mode. In this way, a user eliminates the operation of distinguishing between sheets discharged to a discharge unit 66 into general-purpose sheets 14 and concavo-convex sheets 2. Specifically, a switch 160 is provided on the downstream side of the fixing unit 50, and is moved between the solid line position and dotted line position. The switch 160 is set at the solid line position in the general-sheet operating mode, so that a general-purpose sheet 14 passing through the fixing device 50 is ejected to the discharge unit 66 via a pair of discharge rollers 64, whereas the switch 160 is set at the dotted line position in the concavo-convex sheet operating mode so that a concavo-convex sheet 2 passing through the fixing device 50 passes the switch 160, and thereafter is ejected to a discharge tray 70 through a path 162 provided between the switch 160 and the pair of discharge rollers 68.

Third Embodiment of Image Forming Apparatus

FIG. 12 shows a third embodiment of an image forming apparatus of the present invention. An image forming apparatus 164 provides cassettes 166 and 168 which, respectively, accommodate concavo-convex sheets 2 and general-purpose sheets 14. A concavo-convex sheet 2 is fed from the cassette 166 into a housing 12 by a take-up roller 170, passes through an image removal unit 130 as necessary, and is guided to an image forming unit 20 via a pair of timing rollers 26. A general-purpose sheet 14 is fed from the cassette 168 into the housing 12 by a take-up roller 172, and guided to the image forming unit 20 by the pair of timing rollers 26. A switch 174 is provided on the upstream side of the pair of timing rollers 26, and can be moved between the solid line position for guiding a concavo-convex sheet 2 fed from the cassette 166 to the nip of the pair of timing rollers 26, and the dotted line position for guiding a general-purpose sheet 14 fed from the cassette 168 to the nip of the pair of timing rollers 26.

According to the image forming apparatus 164 having the aforesaid structure, in the general-purpose sheet operating mode, the switches 174 and 45 are respectively set at the dotted line position and the solid line position, such that after a general-purpose sheet 14 is fed from the cassette 168 to the image forming apparatus 20, the sheet passes through the fixing device 50, and through the second path 46 and is ejected to the discharge unit 66. On the other hand, in the concavo-convex sheet operating mode, the switches 174 and 45 are respectively set at the solid line position and the dotted line position, such that after a concavo-convex sheet 2 is fed from the cassette 166 to the image forming apparatus 20, the concavo-convex sheet 2 passes through the convexity cleaning unit 58, and through the third path 48 and is ejected to the discharge tray 70.

An image forming apparatus capable of loading a plurality of paper cassettes such as that of the present embodiment is particularly useful when the operating mode is selected by the user. For example, a user may specify that a particular print job is to be printed using concavo-convex sheets 2 and, accordingly, the image forming apparatus 164 will perform the print job according to the concavo-convex sheet operating mode described above. Alternately, a user may specify that a particular print job is to be printed using general-purpose sheets 14 and, accordingly, the image forming apparatus 164 will perform the print job according to the general-purpose sheet operating mode described above. As another alternative, a user may specify that a particular print job is to be printed using a combination of concavo-convex sheets 2 and general-purpose sheets 14. In this case, the image forming apparatus 164 will switch accordingly between the concavo-convex sheet operating mode and the general-purpose sheet operating mode while performing the print job.

Figure 13:
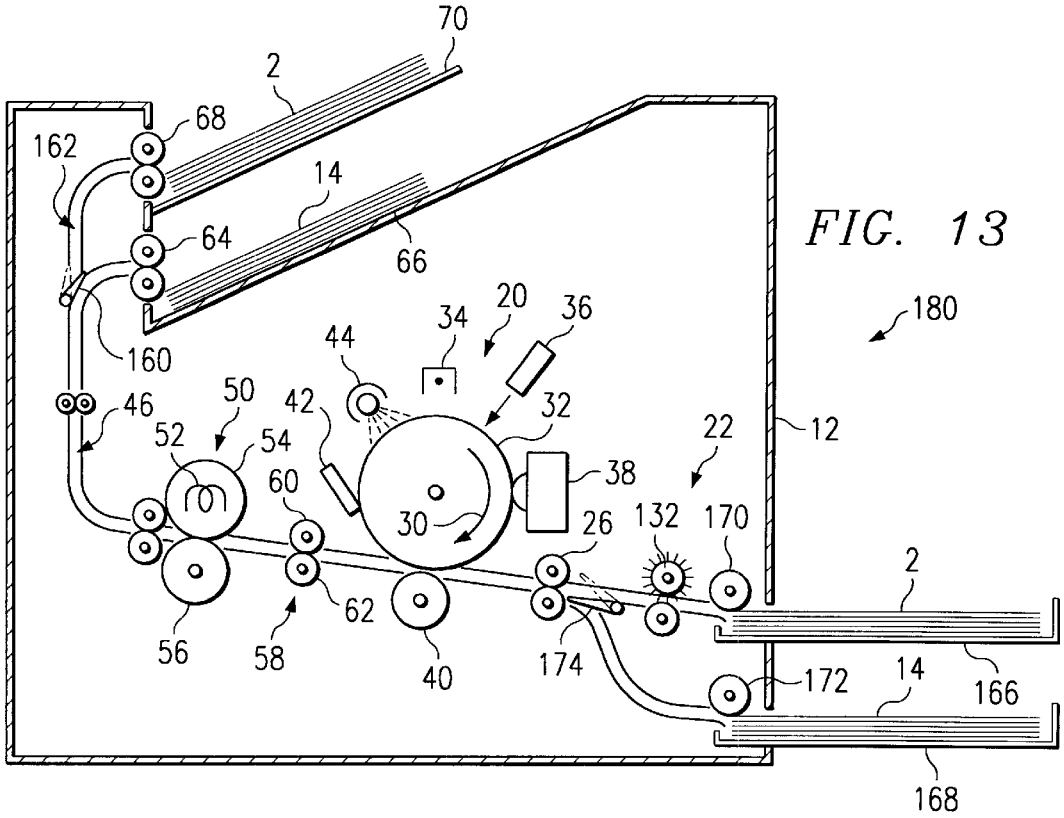
FIG. 13 is a cross-sectional view showing a fourth embodiment of the image forming apparatus of the present invention.

An image forming apparatus capable of loading a plurality of paper cassettes such as that of the present embodiment is also particularly useful when the operating mode is selected by the user. It is possible to accommodate an application Fourth Embodiment of Image Forming Apparatus FIG. 13 shows a fourth embodiment of the image forming apparatus of the present invention. An image forming apparatus 180 is provided with a cassette 166 for concavo-convex sheets 2 and a cassette 168 for general-purpose sheets 14 similar to the image forming apparatus 164 shown in FIG. 12, wherein even the concavo-convex sheets 2 pass through the fixing device 50, and concavo-convex sheets 2 and general-purpose sheets 14 are ejected to separate discharge units similar to the image forming apparatus 140 of FIG. 10.

According to the image forming apparatus 180 having the aforesaid structure, in the general-purpose sheet operating mode, the switches 174 and 160 are respectively set at the dotted line position and the solid line position, such that after a general-purpose sheet 14 is fed from the cassette 168 to the image forming unit 20, the general-purpose sheet 14 passes through the fixing device 50, through the second path 46, and is ejected to the discharge unit 66. On the other hand, in the concavo-convex sheet operating mode, the switches 174 and 45 are respectively set at the solid line position and the dotted line position, such that after a concavo-convex sheet 2 is fed from the cassette 166 to the image forming unit 20, the concavo-convex sheet 2 passes through the convexity cleaning unit 58, through the fixing device 50 wherein the surface temperature of the heating roller 54 has been reduced and the contact force of the pressure roller 56 and heating roller 54 has been reduced, and through the second path 46 and the path 162, and is then ejected to the discharge tray 70.

Other Embodiments of Image Forming Apparatus

The image forming apparatus of the present invention reduces the number of parts, and is advantageously inexpensive and compact by using an electrophotographic method to print both general-purpose sheets and concavo-convex sheets. However, an image forming unit also may be provided specifically for the concavo-convex sheets. For example, a component having a dielectric layer may be substituted for the photosensitive body as an image carrier, such that an electrostatic latent image is formed on the image carrier by an ion flow multistylus method or the like, and after the latent image is developed, the image is transferred to a concavo-convex sheet. Alternatively, toner may be selectively adhered directly to a concavo-convex sheet to form an image, tan electrostatic latent image may be directly formed on a concavo-convex sheet by an ion flow-multistylus method, and thereafter developed to form an image.

Embodiment of Image Removal Device

Figure 14:
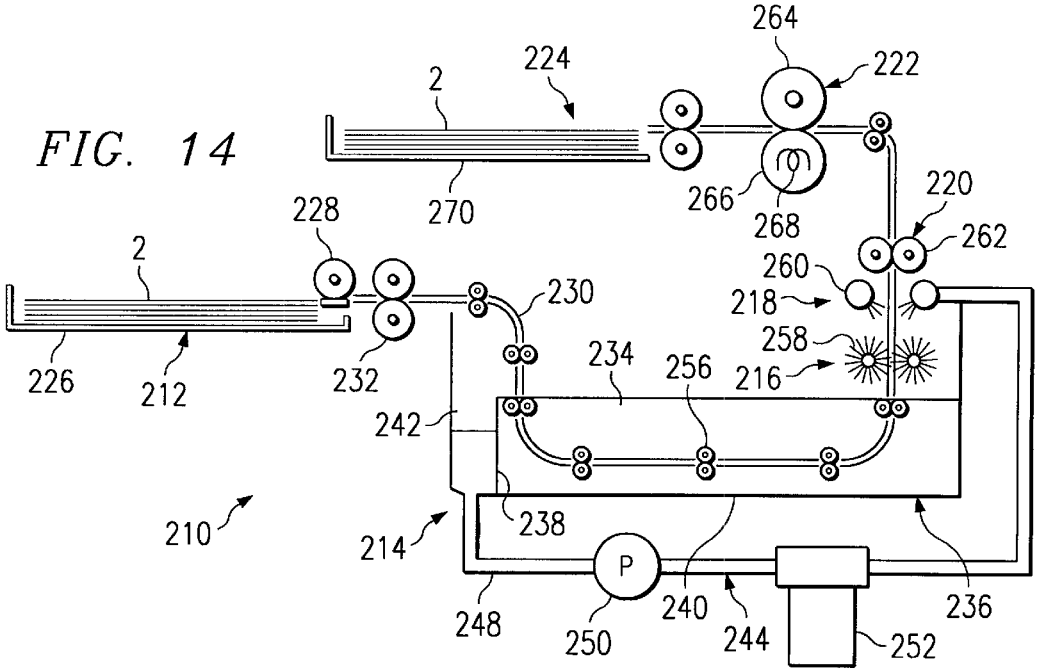
FIG. 14 is a cross-sectional view of an embodiment of an image removal device.

The image removal device provided on the upstream side of the image forming unit removes toner as necessary from the concavities of a concavo-convex sheet by a dry method, as described in the first embodiment of the image forming apparatus. However, the image on the concavo-convex sheet also may be removed by a wet method. FIG. 14 shows an embodiment of the image removal device which removes toner from the concavities of concavo-convex sheets by applying a liquid to the concavo-convex sheet, so as to recycle the sheet to a state wherein this sheet can be reused.

(1) Brief Structure of the Image Removal Device

An image removal device 210 comprises a sheet supply unit 212 for accommodating and supplying a concavo-convex sheet 2 to be recycled by the image removal device 210, an immersion unit 214 for wetting the concavo-convex sheet 2 by applying a liquid to the concavo-convex sheet 2 fed from the sheet supply unit 212, a toner removal unit 216 for removing toner from the thus wetted concavo-convex sheet 2, a rinsing unit 218 for removing foreign matter, such as residual toner remaining on the concavo-convex sheet 2, by spraying a liquid on the concavo-convex sheet 2 from which toner has been removed, a liquid removing unit 220 for removing liquid adhering to the surface of the concavo-convex sheet 2 from which toner has been removed, a drying unit 222 for drying the concavo-convex sheet 2, from which toner has been removed, to a reusable state, and a sheet discharging unit 224 for ejecting and accommodating the dry concavo-convex sheet 2.

(2) Sheet Supply Unit

The sheet supply unit 212 has a sheet tray 226 for accommodating concavo-convex sheets 2. The sheet supply unit 212 has a take-up mechanism 228 for taking up only the uppermost sheet from a plurality of concavo-convex sheets 2 stacked in the sheet tray 226, and a feeding mechanism 232 for feeding the uppermost sheet separated from lower sheets by the take-up mechanism 228 along a sheet transport path 230. In the present embodiment, a take-up device having a pick-up roller which contacts the uppermost sheet and a take-up pad which contact the exterior surface of a pick-up roller is used as the take-up mechanism 228, however, other types of take-up devices may be used. Furthermore, the feeding mechanism 232 normally has a first shaft connected to a drive system, a second shaft arranged parallel to the first shaft, and a plurality of rollers (e.g., rubber rollers) mounted at specific spacing on these shafts, such that a sheet gripped between the rollers mounted on one shaft and the rollers mounted on the other shaft may be transported thereby, such as a conventional roller transport device used as a sheet transport device in copiers and printers.

(3) Immersion Unit

The immersion unit 214 has a vessel 236 for accommodating cleaning fluid (liquid) 234. Although water may be used as the cleaning fluid 234, approximately 0,005~0,01% surfactant (=surfactant weight/water weight) may be added to facilitate removal of toner adhered to the concavo-convex sheet 2. When excess surfactant (0.2% or more) is added, bubbles may be generated within the device, such that cleaning fluid 234 in the form of bubbles may disadvantageously overflow from the vessel 236. Furthermore, too much surfactant may disadvantageously cover the sheet and prevent the drying unit 222 from drying the concavo-convex sheet 2. Other materials also may be added to the cleaning fluid as necessary.

The space within the vessel 236 is divided, by an overflow wall 238, into an immersion bath 240 for immersing the concavo-convex sheet 2, and an overflow tank 242 for accommodating cleaning fluid 234 overflowing from the immersion bath 240. The vessel 236 is provided with a liquid recirculation unit 244 for feeding cleaning fluid 234 overflowing the overflow wall 238 from the immersion bath 240 into the overflow tank 242 back again to the immersion bath 240, and collecting foreign matter (e.g., toner) contained in the cleaning fluid 234 in the process wherein the cleaning fluid 234 is delivered from the overflow tank 242 to the immersion bath 240.

The liquid recirculation unit 244 has a liquid recirculation path 248. One end of the liquid recirculation path 248 is connected to the overflow tank 242, and the other end is position above the immersion bath 240 Accordingly, the cleaning fluid 234 collected in the overflow tank 242 is resupplied from above the fluid surface to the immersion tank 242 The liquid recirculation path 248 has a pump 250 for forcibly recirculating the cleaning fluid 234 along the liquid recirculation path 248, and a filter 252 for removing foreign matter contained in the cleaning fluid 234.

In order to maintain uniform height of the fluid surface in the overflow tank 242, the fluid surface height is measured, and when the fluid level within the overflow tank 242 is below a specific level, cleaning fluid 234 is resupplied from a reserve tank (not shown) to the immersion bath 240.

The immersion bath 240 of the vessel 236 is provided with a plurality of transport mechanisms 256 and a guide member (not shown) for guiding a concavo-convex sheet 2 between the plurality of transport mechanisms 256 to transport a concavo-convex sheet 2 fed from the sheet supply unit 212 within the cleaning fluid 234 in the immersion bath 240. The transport mechanism 256 may use the previously described roller transport device. The guide member may use a pair of opposed guide plates arranged with a specific spacing to hold the sheet transport path 230 therebetween (i.e., plates having a plurality of openings through which pass the cleaning fluid 234), or may use a guide wire (i.e., a plurality of wires extending in the sheet transport direction and arranged with specific spacing in a direction perpendicular to the sheet transport direction).

(4) Toner Removal Unit

The toner removal unit 216 has a pair of opposing brush rollers 258 having the sheet transport path 230 therebetween. These brush rollers 258 use a shaft connected to a drive system, and on the exterior periphery of the shaft is wrapped and attached a foundation fabric having flocked nylon fibers, such that the fibers of the brush roller 258 contact the back surface and front surface of the concavo-convex sheet 2 transported along the sheet transport path 230. The brush rollers 258 are connected to a motor (not shown) such that the toner adhered to the front surface or back surface of the concavo-convex sheet 2 passing between the brush rollers 258 is contacted and removed from the concavo-convex sheet 2.

The circumferential speed of the brush rollers 258 is set from several times to several ten-fold (several 10×) of the transport speed of the concavo-convex sheet 2. To simply described the rotation direction of the brush rollers 258, it is desirable that the drive motor of the brush rollers 258 is controlled such that the fibers of the brush roller 258 move in the sheet transport direction when the leading edge of the concavo-convex sheet 2 enters the opposite part of the brush roller 258, and after the leading edge of the concavo-convex sheet 2 passes the opposite part, the fibers move in the opposite direction to the sheet transport direction.

In the present embodiment, brush rollers 258 are used as a member for removing toner from a concavo-convex sheet 2 through contact with the concavo-convex sheet 2, however, a roller having a flexible mounted member such as a sponge or fabric around a rotating shaft may be used.

(5) Rinsing Unit

The rinse unit 218 has a spray nozzle 260 disposed above the brush rollers 258 holding the sheet transport path 230 therebetween so as to supply cleaning fluid 234 to the front surface and back surface of a concavo-convex sheet 2 passing between or having passed between the pair of brush rollers 258. The spray nozzle 260 is connected to an end of the previously mentioned liquid recirculation path 248, and is supplied with cleaning fluid 234 which has been purified in the liquid recirculation path 248. In the present embodiment, the spray nozzle 260 is formed by a tube having liquid jet holes formed at specific spacing, and the tube is bent 180°.

As shown in the drawing, the brush rollers 258 and the spray nozzle 260 are provided on both sides of the sheet transport path so as to remove an image whether the concavo-convex surface of the concavo-convex sheet 2 in the supply tray 226 is on the bottom side or on the top side; the brush roller 258 and spray nozzle 260 also may be provided on just one side of the sheet transport path.

(6) Liquid Removal Unit

The liquid removal unit 220 has pair of squeeze rollers 262 comprising two rollers disposed so as to confront one another with the sheet transport path interposed therebetween and in mutual contact on the sheet transport path 230. One of the two rollers comprising the pair of squeeze rollers 262 is connected to a motor (not shown).

(7) Drying Unit

The drying unit 222 is disposed on the downstream side of the liquid removal unit 220 for drying the concavo-convex sheet 2 from which cleaning fluid 234 has been removed. In the present embodiment, the drying unit 222 comprises two rollers 264 and 266 disposed so as to confront one another with the sheet transport path interposed therebetween and in mutual contact on the sheet transport path 230. Among the rollers 264 and 266, at least one roller 266 is provided with a built-in heater 268 as a heating source.

Alternatively, for example, an air drier which blows only room temperature air on the sheet, or a built-in heater-type air drier capable of blowing heated air may be substituted for the previously described roller-type heater as the drying means of the drying unit 222.

(8) Sheet Discharge Unit

The sheet discharging unit 224 has a discharge tray 270 for stacking concavo-convex sheets 2 dried by the drying unit 222.

(9) Sheet Recycling Process

The operation of the image removal device 210 having the previously described construction is described below. Specifically, concavo-convex sheets 2 to be recycled are stacked in the supply tray 226. In this state, when the image removal device 210 is started, a plurality of concavo-convex sheets 2 accommodated in the supply tray 226 are sequentially taken up from the uppermost sheet by the take-up mechanism 228, and are supplied to the immersion unit 214 by the feeding mechanism 232.

A concavo-convex sheet 2 supplied to the immersion unit 214 is guided by guide members and transported by the transport mechanism 256 and is immersed for a specific time in the cleaning fluid 234 within the immersion bath 240, and the cleaning fluid 234 penetrates the concavities on the surface layer of the concavo-convex sheet 2. In this way, the force of adhesion between the surface and the toner adhered within the concavities on the surface layer of the concavo-convex sheet 2 is eliminated, and the toner can be separated by simply applying a mechanical force. The front surface and the back surface of the concavo-convex sheet 2 discharged from the cleaning fluid 234 of the immersion bath 240 receive a rubbing force of the pair of brush rollers 258, and the toner adhering to the front surface and back surface is removed by the brush rollers 258. At this time, the front surface and back surface of the concavo-convex sheet 2 are sprayed with cleaning fluid 234 from the spray nozzles 260, and the toner adhered to the part of the sheet having passed through the opposing part of the brush rollers 258 is rinsed therefrom. Toner adhering to the brush rollers 258 is washed down into the immersion bath 240.

Toner which falls into the immersion bath 240 and toner separated from the concavo-convex sheet 2 by the process of transporting the concavo-convex sheet 2 through the immersion bath 240 flows to the overflow tank 242 together with the cleaning fluid 234 flowing from the immersion bath 240 over the overflow wall 238 to the overflow tank 242. Toner contained in the cleaning fluid 234 of the overflow tank 242 is transported by the pump 250 within the liquid recirculation path 248 and is removed by the filter 252. Cleaning fluid 234 from which the toner has been removed is sprayed from the spray nozzles 260 onto the front surface and back surface of the concavo-convex sheet 2, and the brush rollers 258.

The concavo-convex sheet 2 from which toner has been removed is gripped by the pair of squeeze rollers 262 of the liquid removal unit 220, and the cleaning fluid 234 on the surface is removed. Then, the concavo-convex sheet 2 is transported to the drying unit 222 and dried, and thereafter ejected top the discharge tray 270 by the discharging unit 224.

According to the image forming apparatus and method of the present invention, the amount of recording sheets consumed by print output can be reduced by using a general-purpose sheet for long-term storage and presentations, and using a sheet, which can be used for repeated image formation and image removal, for temporary recording and reading.

When printing on a concavo-convex sheet, high-speed output is possible compared to a general-purpose sheet since the toner fixing process is unnecessary, and, accordingly, the time required for temporary reading and viewing is reduced.

Furthermore, operating characteristics, convenience, and work efficiency are improved because the mode for output of a general-purpose sheet and the mode for output of a concavo-convex sheet which can be reused can be switched automatically.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus, comprising:

an image forming unit;

a controller for controlling the image forming unit in a plurality of modes; and a mode-switching unit for switching between the plurality of modes, wherein the plurality of modes includes a first mode for forming an image by applying toner to a general-purpose sheet that is controlled in the first mode to travel through the image forming apparatus along a first path, and a second mode for forming an image by applying toner to a concavo-convex sheet that is controlled in the second mode to travel through the image forming apparatus along a second path, the concavo-convex sheet having a concavo-convex surface on which is formed many concavities capable of receiving toner, wherein at least a portion of the first and second paths is different.

2. An image forming apparatus in accordance with claim 1, further comprising:

a sheet-type detector for detecting whether a sheet is a general-purpose sheet or a concavo-convex sheet, wherein the mode-switching unit switches the image forming apparatus to the first mode when the sheet-type detector detects that the sheet is a general-purpose sheet, and wherein the mode-switching unit switches the image forming apparatus to the second mode when the sheet-type detector detects that the sheet is a concavo-convex sheet.

3. An image forming apparatus in accordance with claim 2, wherein the sheet-type detector distinguishes sheet type based on a form of the sheet when the sheet is at a specific location.

4. An image forming apparatus in accordance with claim 2, wherein the sheet-type detector distinguishes sheet type based on a marking on the sheet when the sheet is at a specific location.

5. An image forming apparatus in accordance with claim 1, further comprising:

a sheet supply unit for receiving sheets from a removable source of sheets; and a source-type detector for detecting whether the removable source of sheets is a source of general-purpose sheets or a source of concavo-convex sheets when the removable source is in a specific location, wherein the mode-switching unit switches the image forming apparatus to the first mode when the source-type detector detects that the removable source is a source of general-purpose sheets, and wherein the mode-switching unit switches the image forming apparatus to the second mode when the source-type detector detects that the removable source is a source of concavo-convex sheets.

6. An image forming apparatus in accordance with claim 1, wherein the mode-switching unit switches to one of the plurality of modes based on a type of application outputting data to the image forming apparatus.

7. An image forming apparatus in accordance with claim 1, wherein the mode-switching unit switches to one of the plurality of modes based on received from outputting data to the image forming apparatus.

8. An image forming apparatus in accordance with claim 1, wherein the mode-switching unit switches to one of the plurality of modes based on user input.

9. An image forming apparatus in accordance with claim 8, further comprising a user input device for allowing a user to select one of the plurality of modes.

10. An image forming apparatus in accordance with claim 1, further comprising an electrostatic latent image carrier, a device for forming an electrostatic latent image on the electrostatic latent image carrier;

a developing device for developing the electrostatic latent image with toner as a toner image;

a transfer device for electrostatically transferring the toner of the toner image onto a general-purpose sheet in the first mode and for electrostatically transferring the toner of the toner image onto a concavo-convex sheet in the second mode; and a fixing device for fixing the thus transferred toner on a general-purpose sheet in the first mode, wherein the fixing device is substantially inactive for fixing toner in the second mode.

11. An image forming apparatus in accordance with claim 10, further comprising a convexity cleaner, disposed on a downstream side of the transfer device relative to a transport direction of a concavo-convex sheet, for removing toner adhered to convexities of a concavo-convex sheet in the second mode.

12. An image forming apparatus in accordance with claim 10, further comprising an image removal unit, disposed on an upstream side of the transfer device relative to a transport direction of a concavo-convex sheet, for removing toner adhered to concavities of a concavo-convex sheet in the second mode.

13. An image forming apparatus in accordance with claim 1, wherein the controller modifies operating conditions of the image forming apparatus based on the mode that is switched to by the mode-switching unit.

14. An image forming method comprising the steps of:

switching between a plurality of modes, wherein the plurality of modes includes a first mode and a second mode;

forming an image, when the first mode has been switched to in the step of switching, by controlling a general purpose sheet along a first path and applying toner onto the general-purpose sheet; and forming an image, when the second mode has been switched to in the step of switching, by controlling a concavo-convex sheet along a second path and applying toner onto the concavo-convex sheet having a concavo-convex surface on which is formed many concavities capable of receiving toner, wherein at least a portion of the first and second paths is different.

15. An image forming method in accordance with claim 14, further comprising the step of:

detecting whether a sheet is a general-purpose sheet or a concavo-convex sheet, wherein, in the step of switching, the first mode is switched to when, in the step of detecting, the sheet is detected to be a general-purpose sheet, and wherein, in the step of switching, the second mode is switched to when, in the step of detecting, the sheet is detected to be a concavo-convex sheet.

16. An image forming method in accordance with claim 14, further comprising the steps of:

receiving sheets from a removable source of sheets; and detecting whether the removable source of sheets is a source of general-purpose sheets or a source of concavo-convex sheets, wherein, in the step of switching, the first mode is switched to when, in the step of detecting, the source of sheets is detected to be a source of general-purpose sheets, and wherein, in the step of switching, the second mode is switched to when, in the step of detecting, the source of sheets is detected to be a source of concavo-convex sheets.

17. An image forming method in accordance with claim 14, wherein, in the step of switching, one of the plurality of modes is switched to based on a type of application outputting data for image formation.

18. An image forming method in accordance with claim 14, wherein, in the step of switching, one of the plurality of modes is switched to based on instructions from an application outputting data for image formation.

19. An image forming method in accordance with claim 14, wherein, in the step of switching, one of the plurality of modes is switched to based on user input.

20. An image forming method in accordance with claim 14, further comprising the steps of:

activating a fixing device for fixing toner on a general-purpose sheet in the first mode, and deactivating the fixing device in the second mode.

21. An image forming method in accordance with claim 14, further comprising the step of removing toner from convexities on a concavo-convex sheet after image formation in the second mode.

22. An image forming method in accordance with claim 14, further comprising the step of cleaning toner from concavities on a concavo-convex sheet before image formation in the second mode.

23. An image forming apparatus comprising:

a first sheet supply unit for receiving a concavo-convex sheet having a concavo-convex surface on which is formed a plurality of concavities and convexities from a removable source of concavo-convex sheets when the removable source of concavo-convex convex sheets is in a specific location, and for receiving a general-purpose sheet from a removable source of general-purpose sheets when the removable source of general-purpose sheets is in the specific location;

an image forming unit for forming an image by applying toner onto a surface of a general-purpose sheet when the first sheet supply unit receives a general-purpose sheet, and for forming an image by applying toner onto the concavo-convex surface of a concavo-convex sheet when the first sheet supply unit receives a concavo-convex sheet; a convexity cleaning unit for removing toner which was applied to the convexities of the concavo-convex surface by the image forming unit; a source-type detector for detecting whether the removable source of concavo-convex sheets or the removable source of general-purpose sheets is in the specific location; and a mode-switching unit for switching between a plurality of modes and respective mode paths, at least a portion of each mode path being different, wherein the plurality of modes includes a first mode for forming an image by applying toner to a general-purpose sheet, and a second mode for forming an image by applying toner to a concavo-convex sheet.

24. An image forming apparatus in accordance with claim 23, wherein the mode-switching unit switches the image forming apparatus to the first mode of the plurality of modes when the source-type detector detects that the removable source of general-purpose sheets is in the specific location, and wherein the mode-switching unit switches the image forming apparatus to the second mode of the plurality of modes when the source-type detector detects that the removable source of concavo-convex sheets is in the specific location.

25. An image forming apparatus in accordance with claim 23, further comprising a user input device for allowing a user to select one of the plurality of modes.

26. An image forming apparatus in accordance with claim 25, further comprising:

a mismatch indicator for providing an indication to a user when the type of removable source detected by the source-type detector to be in the specific location is incompatible with the mode selected by the user via the user input device.

27. An image forming apparatus in accordance with claim 23, wherein the mode-switching unit switches between the plurality of modes based on a type of application outputting data to the image formation apparatus, said image forming apparatus further comprising a mismatch indicator for providing an indication to a user when the type of removable source detected by the source-type detector is incompatible with the mode that is switched by the mode-switching unit.

28. An image forming apparatus in accordance with claim 23, wherein the removable source of general-purpose sheets is a first cassette, and wherein the removable source of concavo-convex sheets is a second cassette.

29. An image forming apparatus in accordance with claim 23, wherein the removable source of general-purpose sheets is a stack of general-purpose sheets, wherein the removable source of concavo-convex sheets is a stack of concavo-convex sheets, and wherein the specific location is a sheet tray.

30. An image forming apparatus in accordance with claim 29, wherein the source-type detector comprises a sheet-type detector, wherein the mode-switching unit switches the image forming apparatus to the first mode of the plurality of modes when the sheet-type detector detects that the removable source of general-purpose sheets is in the specific location, and wherein the mode-switching unit switches the image forming apparatus to the second mode of the plurality of modes when the sheet-type detector detects that the removable source of concavo-convex sheets is in the specific location.

31. An image forming apparatus in accordance with claim 29, further comprising a user input device for allowing a user to select one of a plurality of modes.

32. An image forming apparatus in accordance with claim 31, wherein the source-type detector comprises a sheet-type detector for detecting whether the removable source of concavo-convex sheets or the removable source of general-purpose sheets is in the specific location, said image forming apparatus further comprising a mismatch indicator for providing an indication to a user when the type of removable source detected by the sheet-type detector to be in the specific location is incompatible with the mode selected by the user via the user input device.

33. An image forming apparatus in accordance with claim 29, wherein the source-type detector comprises a sheet-type detector for detecting whether the removable source of concavo-convex sheets or the removable source of general-purpose sheets is in the specific location, wherein the mode-switching unit switches between the plurality of modes based on a type of application outputting data to the image formation apparatus, said image forming apparatus further comprising a mismatch indicator for providing an indication to a user when the type of removable source detected by the sheet-type detector is incompatible with the mode that is switched by the mode switching unit.

34. An image forming apparatus comprising:

a first sheet supply unit for receiving a concavo-convex sheet having a concavo-convex surface on which is formed a plurality of concavities and convexities from a removable source of concavo-convex sheets when the removable source of concavo-convex sheets is in a specific location, and for receiving a general-purpose sheet from a removable source of general-purpose sheets when the removable source of general-purpose sheets is in the specific location;

an image forming unit for forming an image by applying toner onto a surface of a general-purpose sheet when the first sheet supply unit receives a general-purpose sheet, and for forming an image by applying toner onto the concavo-convex surface of a concavo-convex sheet when the first sheet supply unit receives a concavo-convex sheet;

a convexity cleaning unit for removing toner which was applied to the convexities of the concavo-convex surface by the image forming unit; a source-type detector for detecting whether the removable source of concavo-convex sheets or the removable source of general-purpose sheets is in the specific location;

a mode-switching unit for switching between a plurality of modes, wherein the plurality of modes includes a first mode for forming an image by applying toner to a general-purpose sheet, and a second mode for forming an image by applying toner to a concavo-convex sheet;

a fixing device for fixing toner on a general-purpose sheet; a convexity cleaning unit for removing toner adhered to convexities of a concavo- convex sheet; and a path switch for switching between the fixing device and the convexity cleaning unit, wherein the path switch switches to the fixing device in said first mode, and switches to the convexity cleaning unit in said second mode.

35. An image forming apparatus comprising a first sheet supply unit for receiving a concavo-convex sheet from a source of concavo-convex sheets, wherein each of the concavo-convex sheets has a concavo-convex surface on which is formed a plurality of concavities and convexities;

a second sheet supply unit for receiving a general-purpose sheet from a source of general-purpose sheets, a supply-unit switch for switching between the first sheet supply unit and the second sheet supply unit, an image forming unit for forming an image by applying toner onto a surface of a general-purpose sheet when the supply-unit switch is switched to the second sheet supply unit, and for forming an image by applying toner onto the concavo-convex surface of a concavo-convex sheet when the supply-unit switch is switched to the first sheet supply unit;

a convexity cleaning unit for removing toner which was applied to the convexities of the concavo-convex surface by the image forming unit; and an image removal unit, disposed between the first sheet supply unit and the image forming unit, for removing toner from a concavo-convex sheet, wherein the image removal unit includes a conductive roller for removing toner from the concavities of a concavo-convex surface of a concavo-convex sheet.

36. An image forming apparatus in accordance with claim 35, wherein said conductive roller is a conductive brush roller, and wherein said image removal unit includes an opposing roller, and wherein the image removal unit applies a bias voltage between the conductive brush roller and the opposing roller.

37. An image forming apparatus in accordance with claim 35, wherein the image removal unit uses a magnetic force for removing the toner.

* * * * *

UNITED STATES PATENT AND TRADEMARK OFFICE

CERTIFICATE OF CORRECTION

PATENT NO. : 6,577,827 B2
DATED : June 10, 2003
INVENTOR(S) : Masahiko Matsuura et al.

It is certified that error appears in the above-identified patent and that said Letters Patent is hereby corrected as shown below:

Column 2,
Line 40, after “sheets”, insert -- . --.

Column 8,
Line 33, delete “Printer”, and insert -- printer --.

Column 18,
Line 43, after “based on”, insert -- instructions --.
Line 53, after “carrier”, delete “,”, and insert -- ; --.

Column 20,
Line 19, after “concavo-convex”, delete “convex”.

Column 22,
Line 23, delete “concavo- convex”, and insert -- concavo-convex --.
Line 29, after “comprising”, insert -- : --.
Line 36, after “sheets”, delete “,”, and insert -- ; --.
Line 38, after the second instance of “unit”, delete “,”, and insert -- ; --.

Signed and Sealed this

Twenty-seventh Day of April, 2004

JON W. DUDAS
*Acting Director of the United States Patent and Trademark Office*